US008573688B2

(12) United States Patent
Shackelford

(10) Patent No.: US 8,573,688 B2
(45) Date of Patent: Nov. 5, 2013

(54) RECONFIGURABLE SEATING DEVICE WITH INTEGRAL DOCUMENT SHELF

(76) Inventor: Jon E. Shackelford, Chelsea, MI (US)

( * ) Notice: Subject to any disclaimer, the term of this patent is extended or adjusted under 35 U.S.C. 154(b) by 310 days.

(21) Appl. No.: 13/011,231

(22) Filed: Jan. 21, 2011

(65) Prior Publication Data

US 2011/0181079 A1 Jul. 28, 2011

Related U.S. Application Data

(60) Provisional application No. 61/297,910, filed on Jan. 25, 2010.

(51) Int. Cl.
*A47B 39/00* (2006.01)

(52) U.S. Cl.
USPC ..... 297/171; 297/172; 297/173; 297/144; 297/461

(58) Field of Classification Search
USPC ..... 297/461, 173, 144, 119, 120, 105, 140, 297/141, 135, 160, 161, 162, 452.1, 411.3, 297/170, 171, 172; 108/50.11, 92, 99, 9, 10
See application file for complete search history.

(56) References Cited

U.S. PATENT DOCUMENTS

| | | | | | |
|---|---|---|---|---|---|
| 876,023 | A | | 1/1908 | Schurger et al. | |
| 1,030,876 | A | * | 7/1912 | Derry | 108/9 |
| 1,603,233 | A | * | 10/1926 | Conwell et al. | 108/154 |
| 2,516,498 | A | * | 7/1950 | Womock, Jr. | 297/163 |
| 2,766,812 | A | * | 10/1956 | Schrader | 297/141 |
| 3,367,713 | A | * | 2/1968 | Krueger | 297/162 |
| 3,420,571 | A | * | 1/1969 | Moore | 297/124 |
| 3,963,096 | A | | 6/1976 | Jones | |
| 4,359,243 | A | | 11/1982 | Crutcher | |
| 4,561,339 | A | | 12/1985 | Jensen | |
| 4,614,378 | A | | 9/1986 | Picou | |
| 4,618,183 | A | | 10/1986 | Bauer | |
| 4,645,261 | A | | 2/1987 | Bourne et al. | |
| 5,074,619 | A | * | 12/1991 | D'Orsi et al. | 297/236 |
| 5,375,514 | A | | 12/1994 | Dann, Jr. | |
| D355,773 | S | | 2/1995 | MacOwen | |
| 5,988,738 | A | * | 11/1999 | Blessing et al. | 297/141 |
| D457,011 | S | | 5/2002 | Wenner et al. | |
| 6,431,645 | B2 | * | 8/2002 | Massara et al. | 297/144 |
| 6,601,865 | B1 | * | 8/2003 | Harper | 280/304.1 |
| 6,604,783 | B2 | * | 8/2003 | Goodson | 297/170 |
| 6,945,597 | B1 | | 9/2005 | Brown et al. | |
| 7,106,014 | B1 | | 9/2006 | Mastalir et al. | |
| 7,314,248 | B2 | | 1/2008 | Mabon et al. | |

* cited by examiner

*Primary Examiner* — David Dunn
*Assistant Examiner* — Alexander Harrison
(74) *Attorney, Agent, or Firm* — Endurance Law Group PLC

(57) ABSTRACT

A seating device (20) includes a fixed seat (24) and a moveable arm (40) pivotally connected at its lower end (44) to a support structure (26). A document shelf (22) is carried on an upper end (42) of the moveable arm (40). In an inactive stowed condition, the document shelf (22) innocuously lays over the fixed seat (24). The document shelf (22) is movable to a deployed condition extending laterally outwardly and upwardly relative to the fixed seat (24) where documents may be held at a convenient reading distance to a person seated on the fixed seat (24). The moveable arm (40) is telescopically extendable. A stop cord (92) limits outward rotation of the moveable arm (40). A recessable joint (46) connects the document shelf (22) to the moveable arm (40). In the stowed condition, the recessable joint (46) tucks below the fixed seat surface. The document shelf (22) includes a back plate (56) and a perpendicular ledge (58). The document shelf (22) has two alternative modes in the deployed condition: a lectern mode and a side table mode. A table bracket (106) supports the document shelf (22) in the side table mode.

18 Claims, 12 Drawing Sheets

RECONFIGURABLE SEATING DEVICE WITH INTEGRAL DOCUMENT SHELF

CROSS REFERENCE TO RELATED APPLICATIONS

This application claims the benefit of U.S. Provisional Patent Application Ser. No. 61/297,910 filed Jan. 25, 2010, the entire disclosure of which is hereby incorporated.

BACKGROUND OF THE INVENTION

1. Field of the Invention

A seating device that may be partially reconfigured in use to present a previously inaccessible non-occupant supporting surface, and more particularly a seating device with an integrated, selectively deployable document shelf.

2. Related Art

People often need to see written materials while seated. In circumstances where the seated person is simultaneously engaged in another activity that makes holding the reading materials difficult, they may require a nearby stand or elevated shelf to support their reading materials. Situations in which a nearby stand or shelf is needed to hold reading materials might include activities where the person's hands are otherwise occupied, such as with musicians and artists, or activities that require the person to frequently leave and return to their seat, as with teachers. In such cases a combined seat and document shelf assembly, integrated together as a multi-function unit, could be preferred over two disconnected pieces of furniture.

Some examples of combined seat and shelf assemblies are found in the prior art. U.S. Pat. No. 876,023 to Schurger, issued Jan. 7, 1908, discloses a stool for musicians. The Schurger stool includes a support structure in the form of three extendable legs cooperating with a central vertical shaft that extends downwardly from a seat surface. A multi-linked arm is moveably connected to the support structure. The moveable arm has an upper end that extends laterally outwardly and upwardly to hold a document shelf at a convenient reading distance laterally elevated relative to the seat surface for a seated user. For storage or transport, however, the document shelf is removed completely from the assembly. Thus, one shortcoming of the Schurger stool concept is the inability to collapse its document shelf in a self-contained stowed condition integral with the seating device so that the seat surface remains fully functional as a body support.

U.S. Pat. No. 4,614,378 to Picou, issued Sep. 30, 1986, discloses a chair that can be reconfigured to support a human body in either a traditional sitting posture or a kneeling posture. A support structure, in the form of interconnected links and legs, extends downwardly from a seat surface. In Picou's preferred embodiment (FIG. 10), an adjustable arm is moveably connected to the support structure. The moveable arm has an upper end that extends laterally outwardly and upwardly to hold a document shelf at a convenient reading distance laterally elevated relative to the seat surface for a seated musician. The document shelf is affixed to the support structure by a nut and bolt arrangement. Picou's document shelf, like Schurger's, is intended to be removed completely from the seat portion for storage or transport. In neither case can the document shelf be innocuously stowed as part of an integral assembly when it is not needed.

U.S. Pat. No. 7,314,248 to Mabon, issued Jan. 1, 2008, discloses a wheeled seat device having a collapsible support structure to facilitate portability. A document shelf is supported at the upper end of a telescopic arm that is, in turn, moveably connected to the support structure. When the seating device is in use, the document shelf may be positioned to extend laterally outwardly and upwardly to hold documents and other articles at a convenient distance laterally elevated relative to the seat surface. However, for transport, the document shelf collapses together with the seat and support structure into a wheeled pull cart. Mabon's seat device therefore is not capable of collapsing its integrated document shelf in a stowed condition adjacent to the seat surface while the seat surface remains functional as a body support.

Accordingly, there exists a need for a seating device having an integrated document shelf that can be deployed for use or alternatively stowed unobtrusively without compromising the normal seating functionality of the device in either condition.

SUMMARY OF THE INVENTION

A seating device is provided that may be reconfigured in use without destroying the utility of said device as a body support. The device comprises a seat surface for supporting a human body in a sitting posture. A support structure extends downwardly from the seat surface for supporting the seat surface at an elevated position above a floor. A moveable arm has upper and lower ends. The lower end of the moveable arm is moveably connected to the support structure, while the upper end of the moveable arm extends laterally outwardly and upwardly therefrom in a deployed condition. A document shelf is connected to the upper end of the moveable arm in the lectern mode to support documents at a convenient reading distance laterally elevated relative to the seat surface while the seat surface supports a human body. The improvement comprises a recessable joint connecting the document shelf and the moveable arm. The recessable joint is moveable to a tucked position directly below the seat surface in conjunction with reconfiguration of the document shelf to an alternate stowed condition adjacent the seat surface. The functionality of the seat surface as a body support is substantially unimpeded when the document shelf is in the stowed condition because the recessable joint tucks below the seat surface.

The invention overcomes the shortcomings and disadvantages of the prior art by providing an integrated seating device and document shelf that can be selectively placed in either a deployed or stowed condition. When deployed, the document shelf is held out by the moveable arm at a convenient reading distance laterally elevated relative to the seat surface. When stowed, the document shelf is stored inactive adjacent the seat surface. In the stowed condition, the recessable joint that connects the document shelf to the moveable arm is tucked under the seat surface. Whether stowed or deployed, the seat surface maintains its functionality to support a human body.

BRIEF DESCRIPTION OF THE DRAWINGS

These and other features and advantages of the present invention will become more readily appreciated when considered in connection with the following detailed description and appended drawings, wherein.

DETAILED DESCRIPTION OF THE PREFERRED EMBODIMENT

Figure 1:
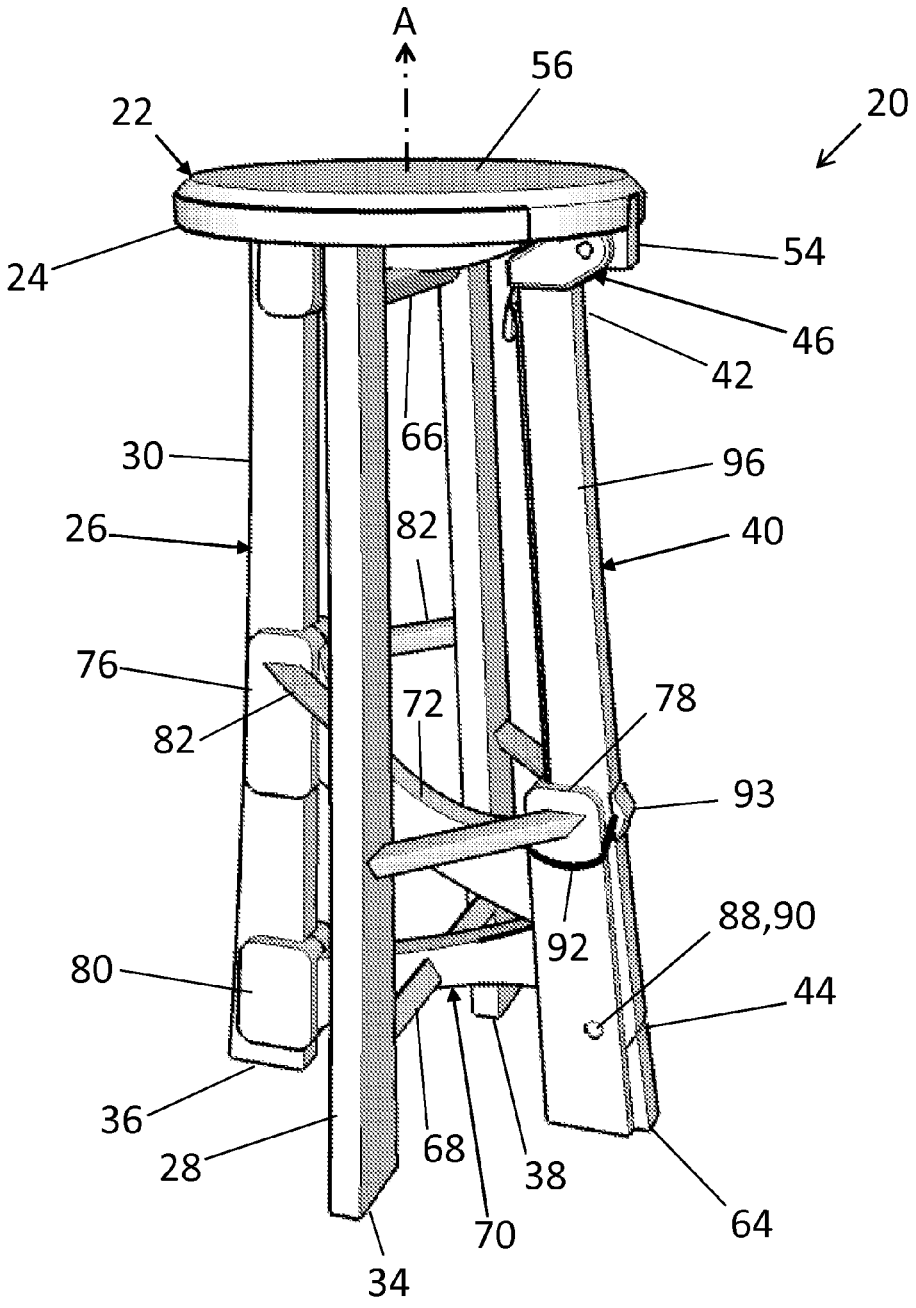
FIG. 1 is a perspective view of a seating device according to the subject invention showing a document shelf disposed in an inactive stowed condition.

Referring to the Figures, wherein like numerals indicate like or corresponding parts throughout the several views, a seating device according to one embodiment of the invention is generally shown at 20. In this embodiment, the seating device 20 takes the form of a medium height stool, however other types of furniture for sitting may be substituted, such as chairs or benches or the like. The seating device 20 may be partially reconfigured in use to deploy a previously inaccessible non-occupant supporting surface, and in particular a document shelf, generally indicated at 22, without destroying the utility of the device 20 as a human body support. It will be understood that the document shelf 22 may be suitable for supporting many types of reading or reference materials, including loose papers, books and magazines. In one embodiment of the invention, the document shelf 22 is ideally suited to support electronically presented documents via a display screen, such as on a notebook computer, e-Reader, or some type of handheld device. The seating device 20 includes a fixed seat 24 having a top seat surface for supporting the buttocks of an ordinary human being. The top surface of the fixed seat 24 may be flat as shown or sculpted or otherwise shaped, textured, woven or padded. The fixed seat 24 may be generally circular as shown, or any other desirable geometric shape. When the document shelf 22 is deployed, the fixed seat 24 is exposed for direct contact with a seated occupant. When the document shelf 22 is in a stowed condition, as will be described more fully below, it harmlessly overlies the fixed seat 24 to be rested upon by a seated occupant.

A support structure, generally indicated at 26, extends downwardly from the fixed seat 24 for supporting the fixed seat 24 at an elevated position above a floor. The support structure 26 may be any type of rigid or resilient construction capable of holding the fixed seat 24 above the floor so as to sustain a human occupant in a sitting posture. In the embodiment shown, the support structure 26 includes first 28, second 30 and third 32 legs extending downwardly from the fixed seat 24 to respective distal ends 34, 36, 38 for supporting the fixed seat 24 at an elevated position above the floor surface. The fixed seat 24 may be attached directly to the uppermost ends of the first 28, second 30 and third 32 legs. In the disclosed embodiments of this invention, the fixed seat 24 does not move relative to the support structure 26 as the document shelf 22 is reconfigured between stowed and deployed conditions.

The first 28, second 30 and third 32 legs have a generally equivalent length in the illustrated example. An imaginary center line A may be thought of passing more or less centrally through the fixed seat 24, as shown in FIGS. 1-4, 7 and 10. The first 28, second 30 and third 32 legs are generally equally radially spaced from the centerline A. While many variations of the support structure 26 are possible, including more or less than the preferred three legs 28-32, in this embodiment the first 28 and third 32 legs are generally diametrically opposed relative to the centerline A. The second leg 30 is spaced generally circumferentially equally between the first 28 and third 32 legs relative to the centerline A. In other words, the first 28 and third 32 legs are arcuately spaced from the second leg 30 in either direction about 90 degrees. Again, those of skill in the art will readily appreciate the substantial opportunity for variability in these features, including adjustable length legs and/or seat height designs.

The device 20 includes a moveable arm, generally indicated at 40. The moveable arm 40 has upper 42 and lower 44 ends. The lower end 44 is moveably connected to the support structure 26 and the upper end 42 extends laterally outwardly and upwardly therefrom in the deployed condition. The document shelf 22 is hingedly connected to the upper end 42 of the moveable arm 40 via a recessable joint, generally indicated at 46, shown perhaps best in FIG. 11. The recessable joint 46 is moveable, together with articulation of the moveable arm 40, to a tucked position directly below the seat surface in conjunction with reconfiguration of the document shelf 22 to the previously mentioned stowed condition. Preferably, the recessable joint 46 slips underneath and within the peripheral area upon which a seated occupant rests their buttocks so as to avoid any user discomfort.

Figure 2:
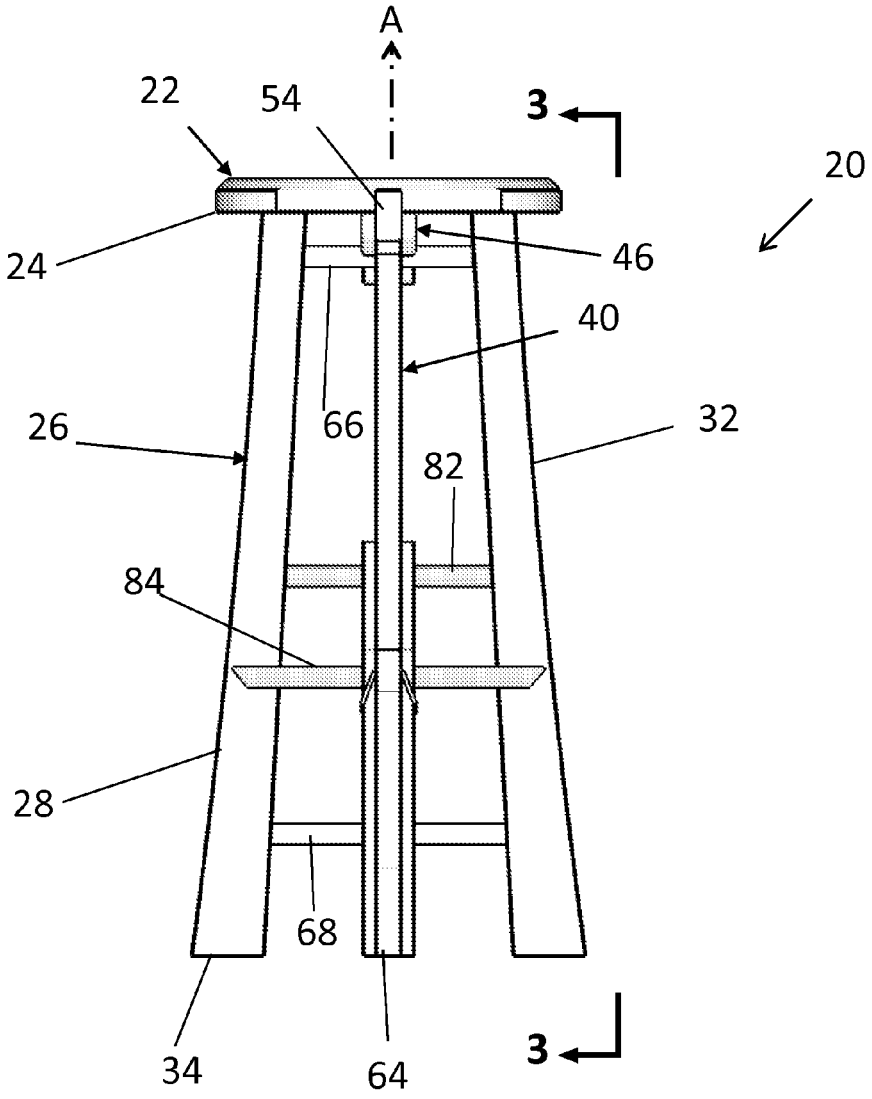
FIG. 2 is a side elevation view of the seating device of FIG. 1.
Figure 3:
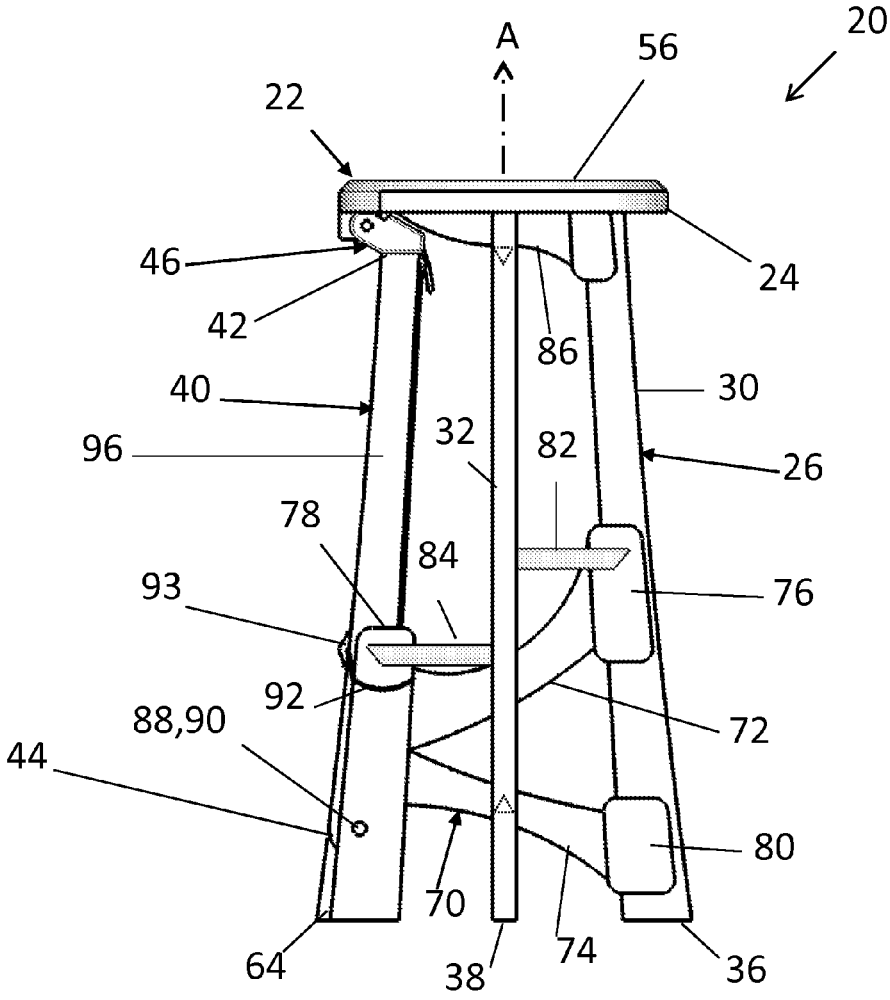
FIG. 3 is a view of the seating device taken generally along lines 3-3 in FIG. 2.
Figure 4:
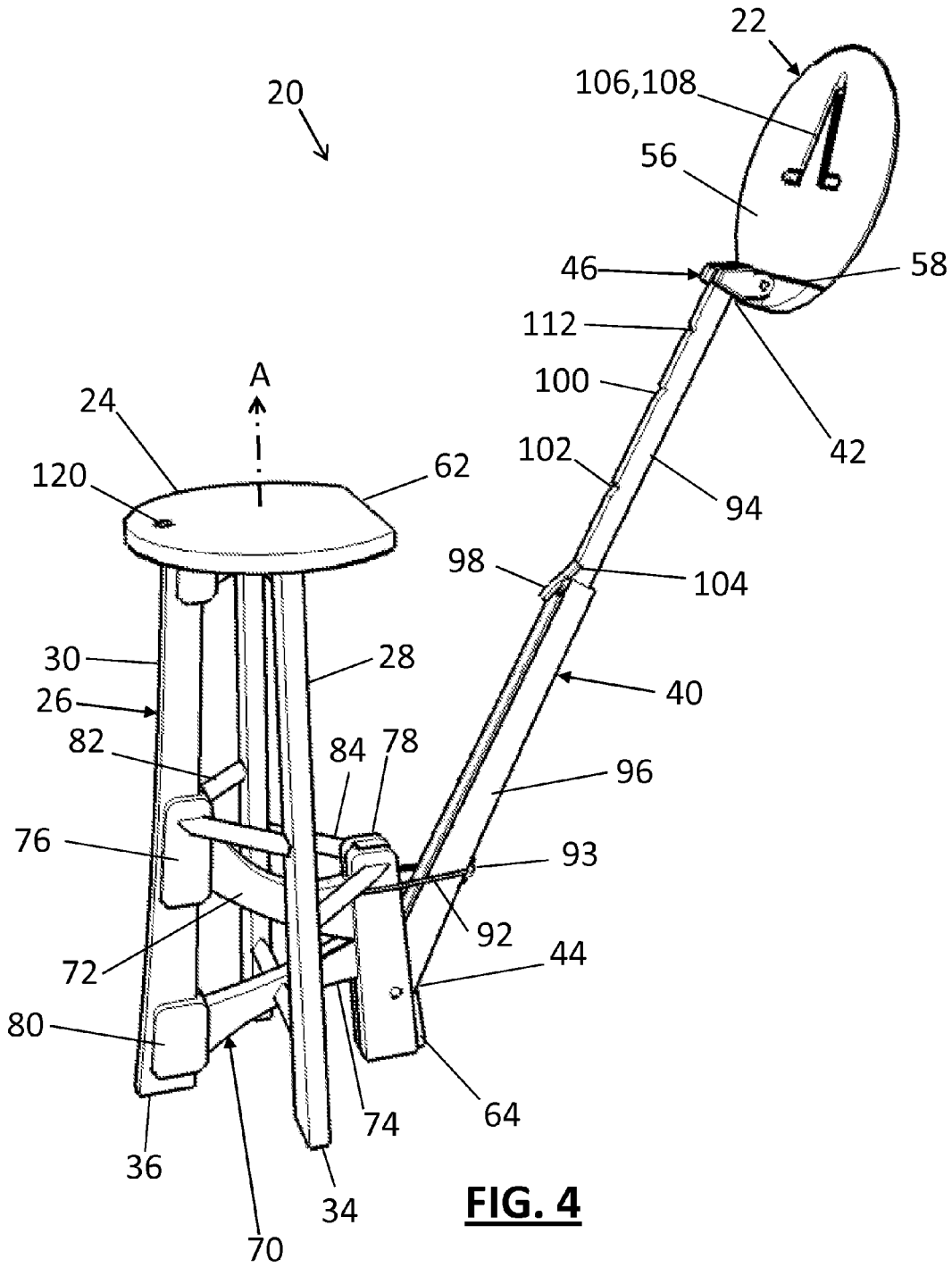
FIG. 4 is a perspective view of the seating device showing the document shelf in a deployed lectern mode, fully extended in height.
Figure 5:
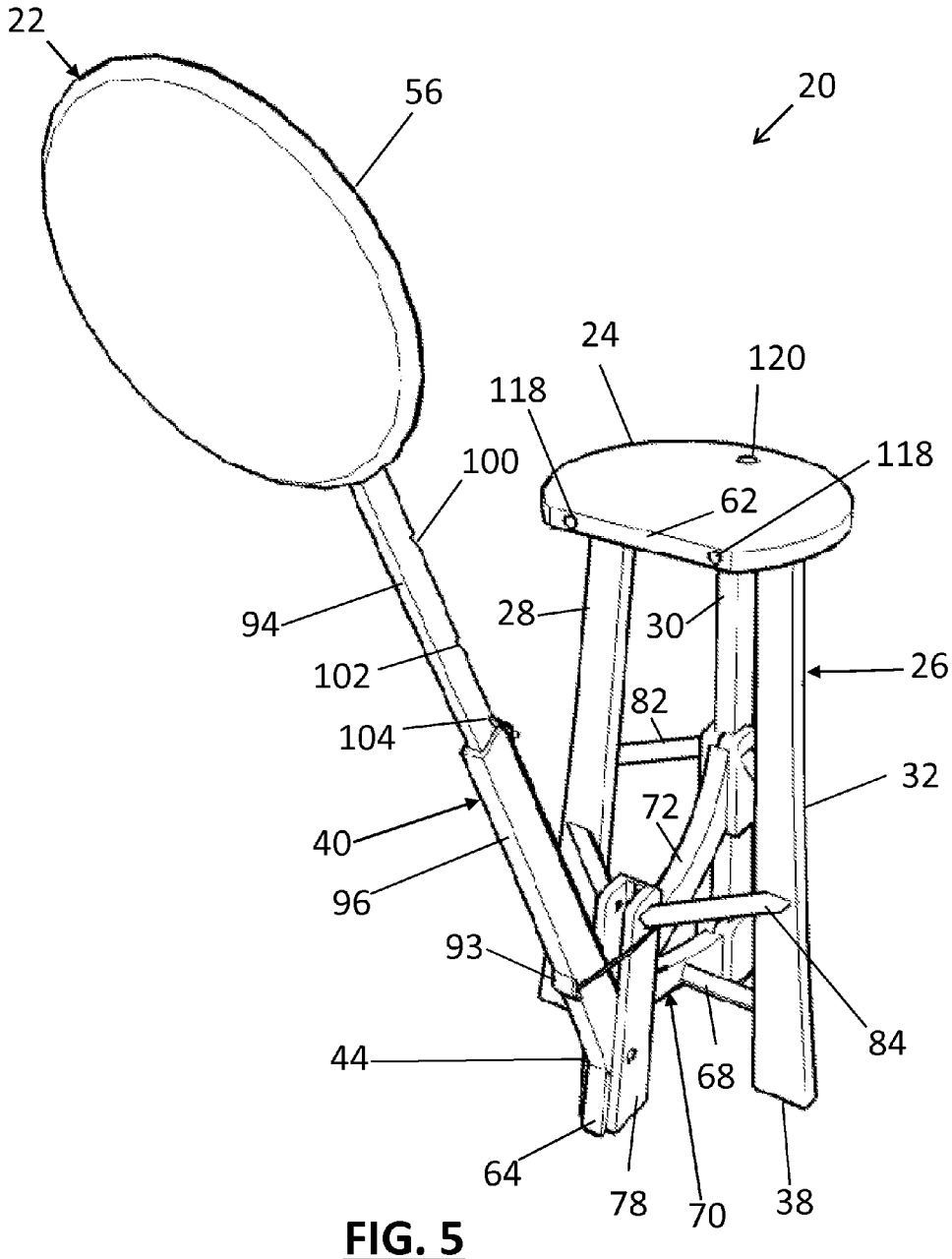
FIG. 5 is another perspective view of the seating device as in FIG. 4 but from a different point of view.
Figure 6:
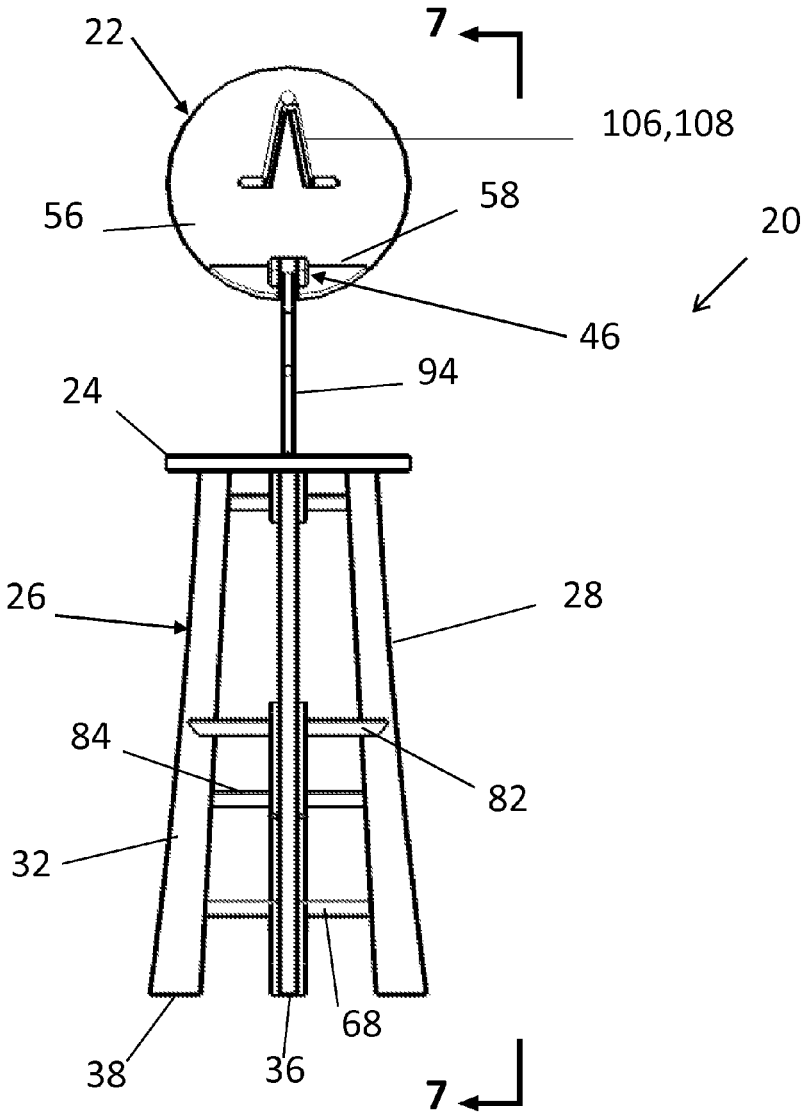
FIG. 6 is a side elevation view of the seating device of FIGS. 4 and 5.
Figure 7:
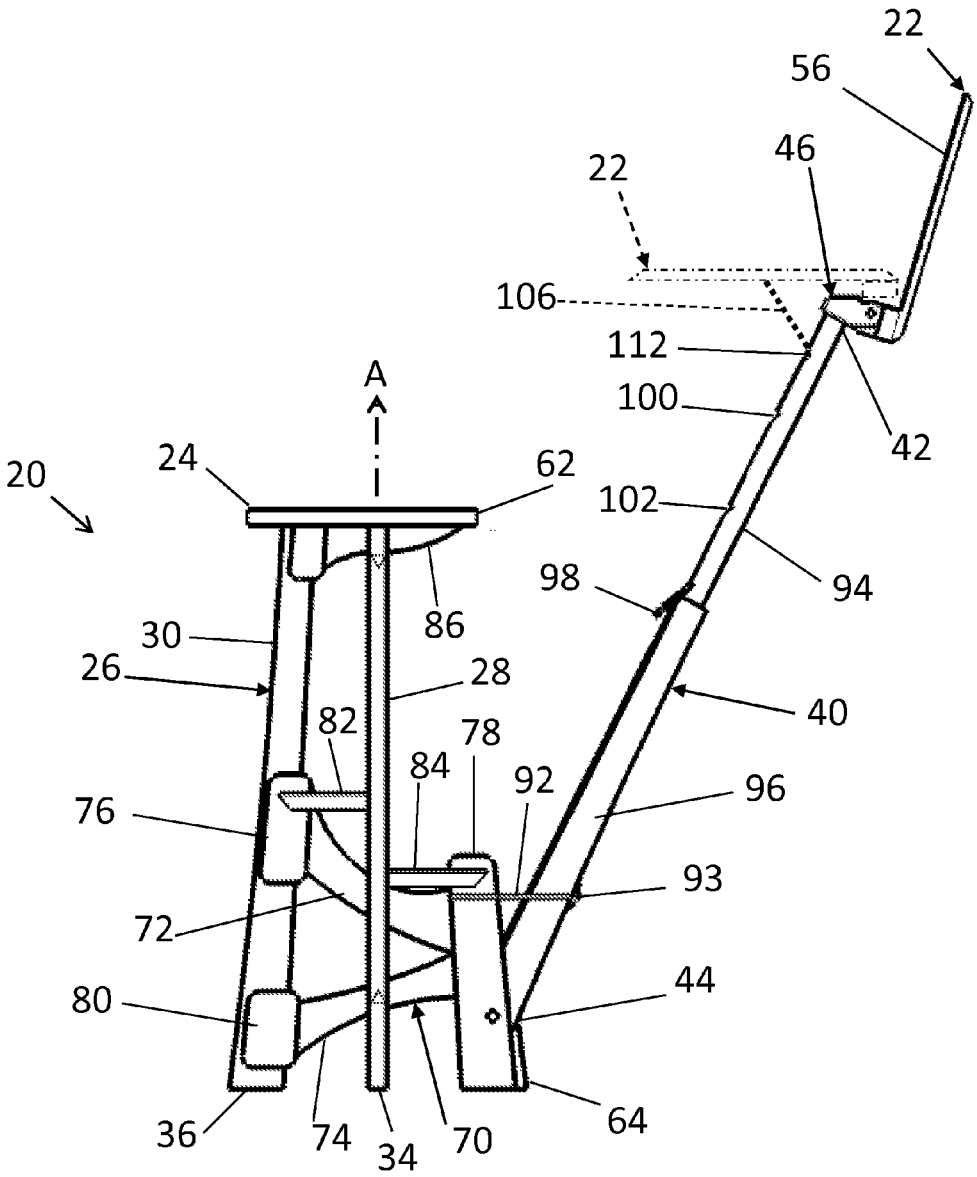
FIG. 7 is a view of the seating device taken generally along lines 7-7 in FIG. 6.
Figure 8:
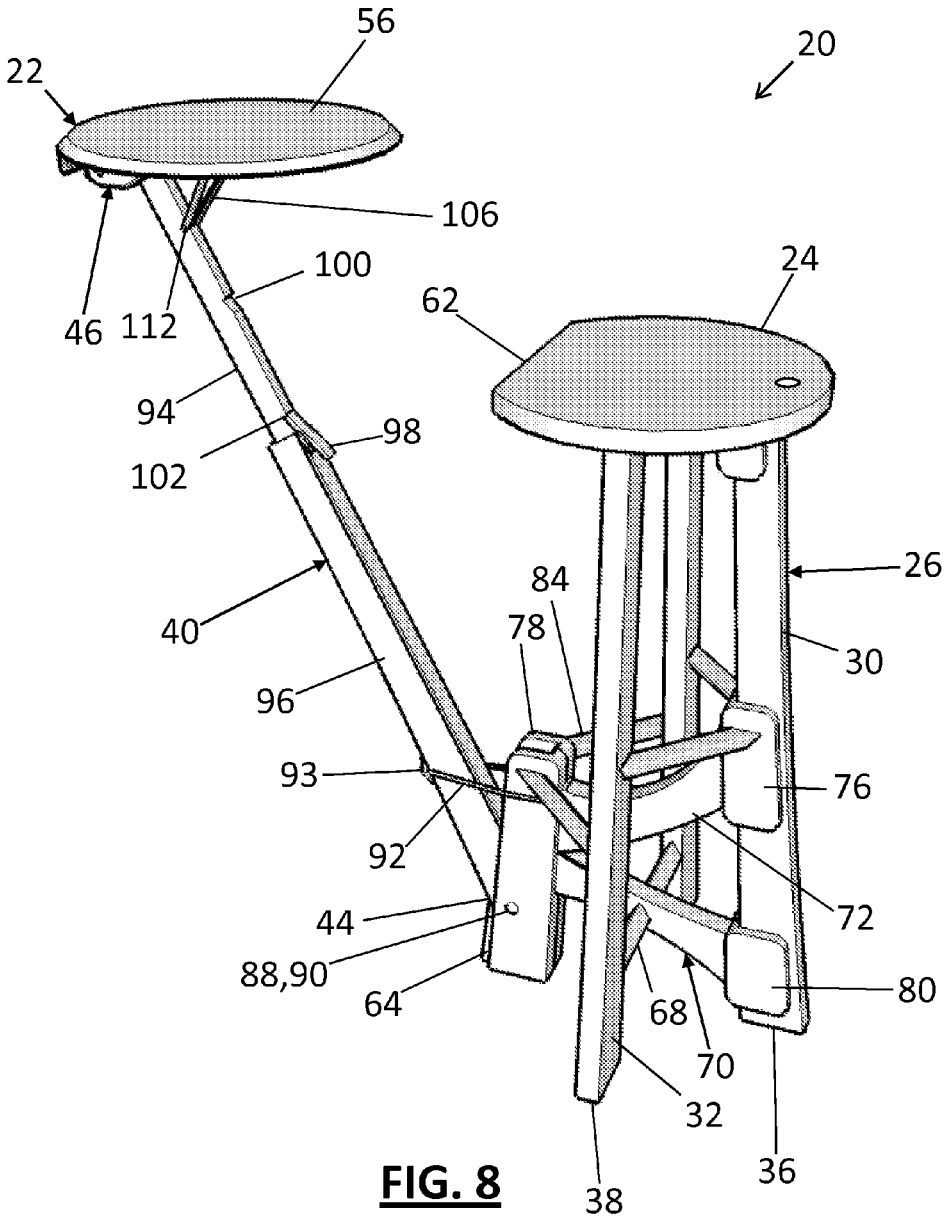
FIG. 8 is a perspective view of the seating device showing the document shelf in a deployed side table mode.
Figure 9:
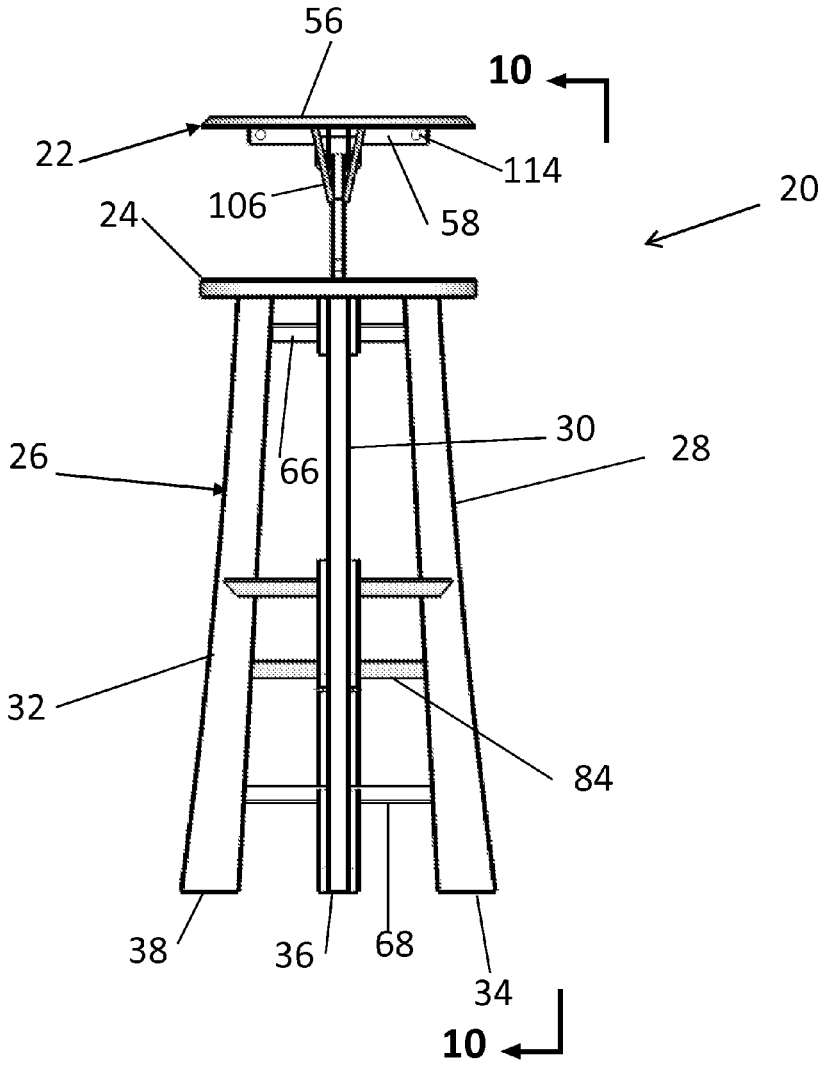
FIG. 9 is a side elevation view of the seating device of FIG. 8.
Figure 10:
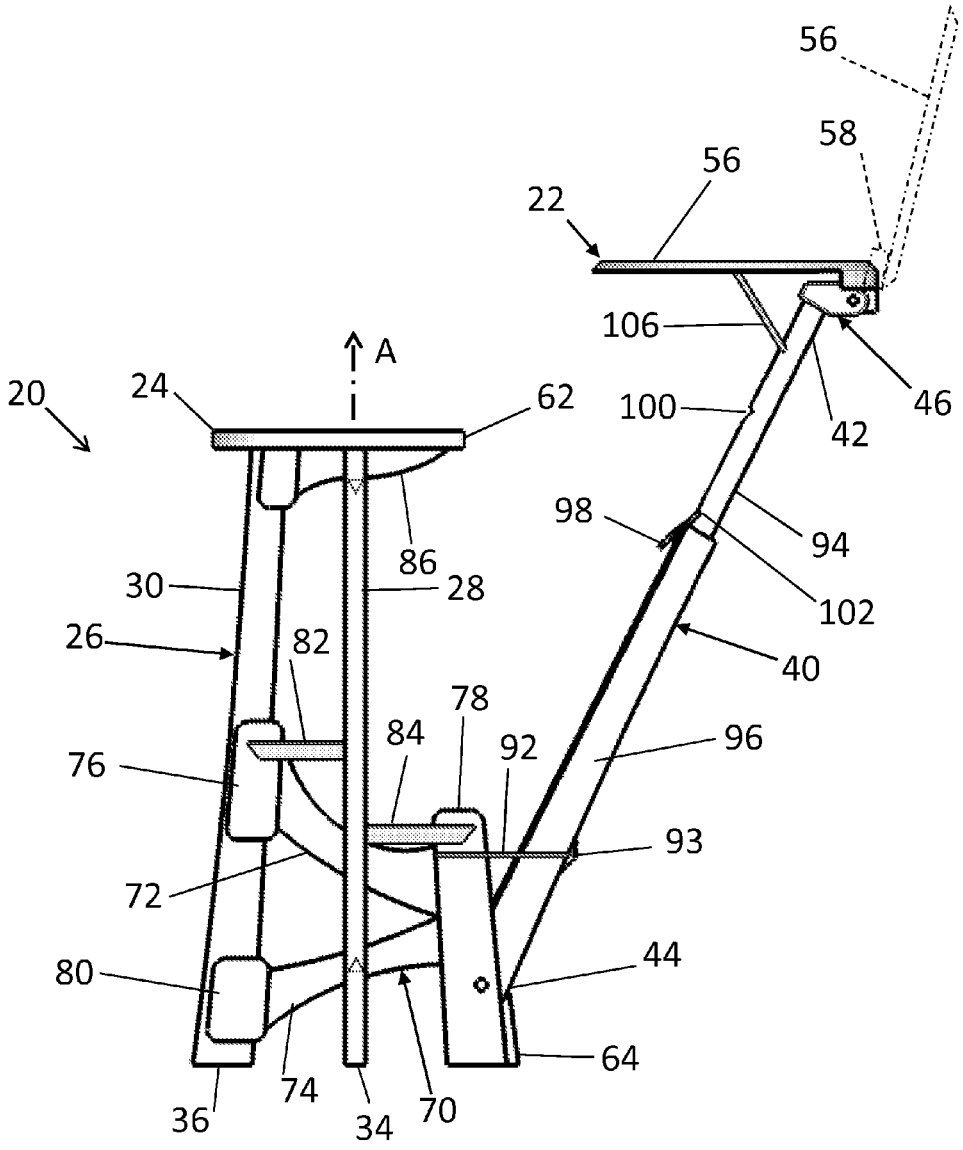
FIG. 10 is a view of the seating device taken generally along lines 10-10 in FIG. 9.

The stowed condition is shown in FIGS. 1-3, and is distinguished from the various modes of the deployed condition illustrated in FIGS. 4-10. Specifically, the document shelf 22 of the illustrated embodiment has two alternative modes when in the deployed condition: a lectern mode and a side table mode. The lectern mode is shown in FIGS. 4-7. The side table mode is shown in FIGS. 8-10. Those of skill in the art, however, will appreciate that the seating device 20 could be redesigned to enable only one of the two modes of operation for the document shelf 22 when in the deployed condition, i.e., either the lectern mode or the side table mode but not both. The functionality of the device 20 as a body support, and the functionality of the fixed seat 24 in particular, is not compromised when deployed in either the lectern mode or the side table mode. Likewise, the device 20 retains all of the functionality normally required for sitting in the stowed condition as well, although in this state the document shelf 22 is generally non-functional as a document support. Said another way, the functionality of the seat surface as a body support is substantially unimpeded whether the document shelf 22 is in the inactive stowed configuration (where the recessable joint 46 is tucked below the seat surface) or one of the active deployed conditions.

Figure 11:
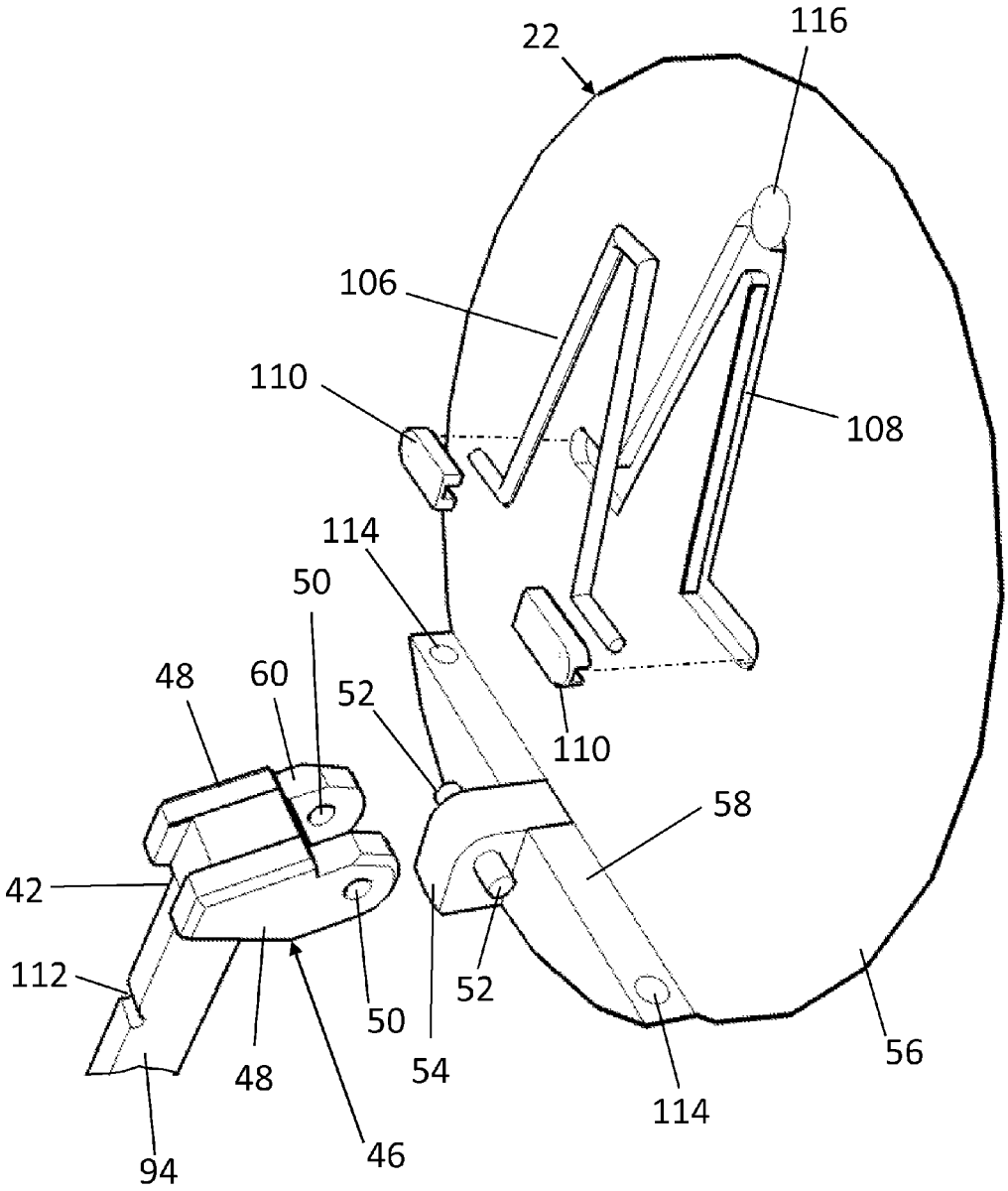
FIG. 11 is a fragmentary perspective view of the document shelf showing exploded therefrom a table bracket feature and a recessable joint feature.
Figure 12:
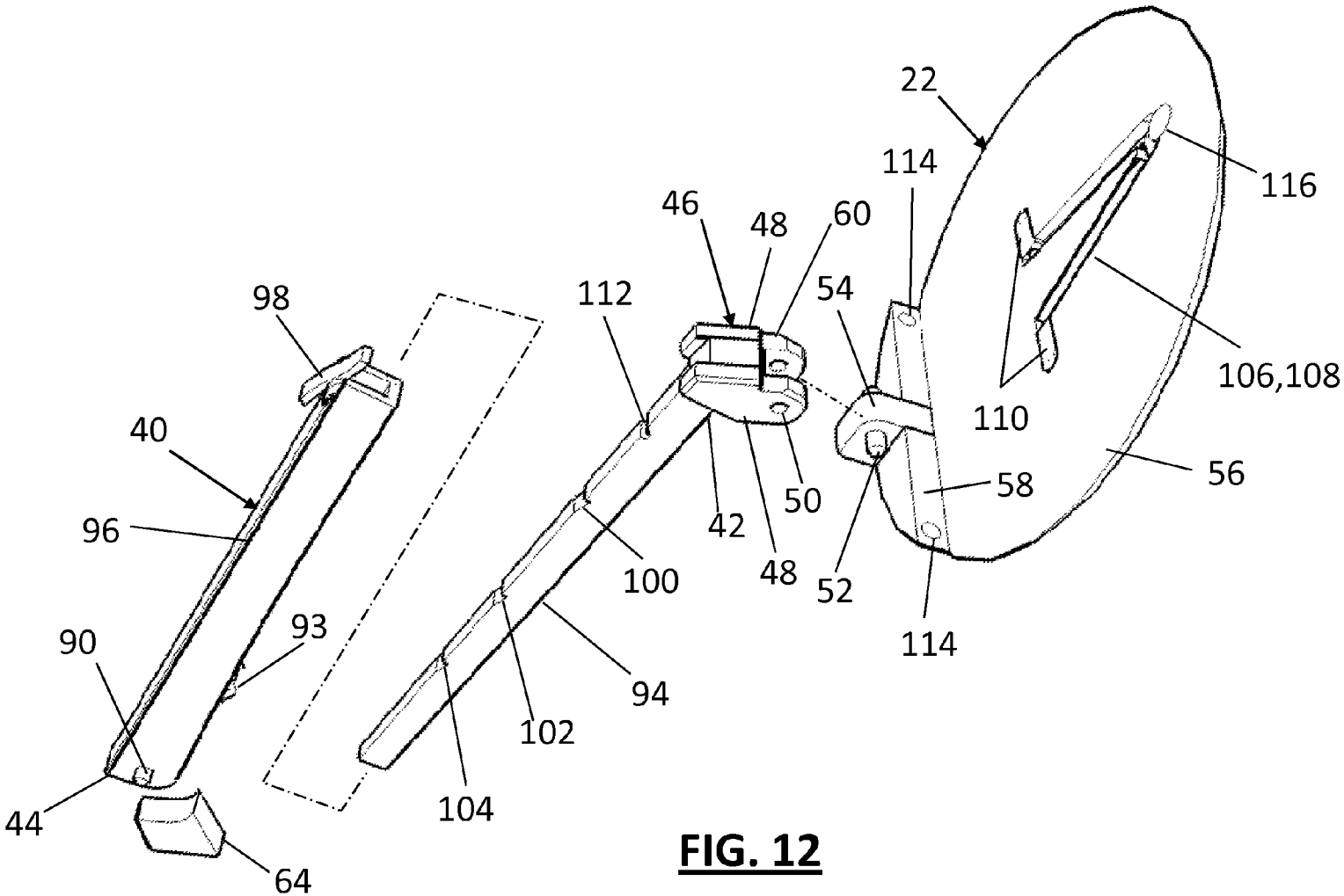
FIG. 12 is an exploded view of the moveable arm and document shelf features.

In the deployed lectern mode, the document shelf 22 is placed at a laterally extended and elevated position, via manual reconfiguration of the moveable arm 40, so as to provide a convenient perch for sheet music, lecture notes, books, folders, or other documents and articles. As shown in FIGS. 11 and 12, the recessable joint 46 may include a dog-legged section or member 48 offset laterally relative to the moveable arm 40. The dog-legged member 48 may be structured in various forms, but in the illustrated embodiment comprises a pair of members disposed on flanking sides of the upper end 42. Aligned hinge holes 50 are formed in each of the dog-legged members 48 for receiving pintles 52 extending from the document shelf 22. The pintles 52 are carried in a tab 54 that depends from the document shelf 22 and fits with a snug sliding clearance between the dog-legged members 48. The interleaved dog-legged member 48, tab 54 and pintles 52 provide a robust hinged connection without undue wiggle so as to permit smooth and controlled pivotal motion relatively between the moveable arm 40 and document shelf 22. The laterally offset nature of the dog-legged members 48 is useful in bringing the upper end 42 of the moveable arm 40 below the seat surface and below the fixed seat 24 when in the stowed condition, as shown in FIGS. 1 and 3. The recessable joint 46 may be designed in any variety of alternative ways, including with multiple mechanical links, joints, sliding features, bendable features, etc. A multi-position detent feature could be incorporated into the recessable joint 46 to permit adjustment of the document shelf 22 to several pre-set angles in the deployed lectern mode.

The document shelf 22 includes a back plate 56 and a ledge 58 oriented generally perpendicular to the back plate 56. In the deployed lectern mode, sheet music documents or other articles may be positioned so as to rest under the influence of gravity against the back plate 56 and ledge 58. Ideally, in the lectern mode, the back plate 56 is angled slightly past vertical and the ledge 58 is likewise tilted slightly above horizontal to cradle documents in the tradition manner of a music stand or lectern. This is perhaps best shown in FIG. 7. However, when the document shelf 22 is positioned in the side table mode, the back plate 56 assumes a generally horizontal attitude and the ledge 58 a generally vertical orientation. See for comparison FIGS. 8-10. The recessable joint 46 may include a relief 60 to provide clearance for the document shelf 22 when in the docked and side table modes (FIGS. 11 and 12). The relief 60 formed in the top side of the recessable joint 46 allows the ledge 58 to rotate fully to its stowed or side table mode without colliding against the dog-legged section 48 (FIGS. 7 and 10). Of course, alternative designs of the recessable joint 46 may obviate the need for the relief 60.

In the illustrated embodiment, where the fixed seat 24 is generally round, the back plate 56 of the document shelf 22 is also generally round and generally of the same circular dimensions. Therefore, when in the stowed condition, the back plate 56 of the document shelf 22 neatly overlays the fixed seat 24 in more or less perfect alignment. Of course, many alternative seat designs are possible, such that this dimensional relationship between the back plate 56 and fixed seat 24 may vary substantially. The fixed seat 24 is provided with an indentation 62 comprising, in at least the preferred embodiment, a removed chord from its otherwise full circular shape. The ledge 58 portion of the document shelf 22 has a complimentary chord shape so that it nests against the fixed seat 24 to complete its circular shape in the stowed condition. In other words, the indentation 62 provides clearance for the ledge 58 of the document shelf 22 when disposed in the stowed condition. In this nested posture, the document shelf 22 is generally ineffective as a means for supporting documents or other articles at a distance from the seat surface. Indeed, in the illustrated embodiment, the back plate 56 benignly overlies the fixed seat surface in the stowed condition, as shown in FIGS. 1-3, and becomes trapped there when the seating device 20 is in use. By contrast, when deployed, the document shelf 22 is separated from the fixed seat surface in both the lectern and side table modes of operation. It will thus be apparent that the document shelf 22 cooperates innocuously with the fixed seat surface of the device 20 when in the stowed condition for supporting a human body in a sitting posture.

The support structure 26 illustrated in the figures further includes a short leg 64 disposed generally diametrically opposite to the second leg 30 relative to the centerline A. The short leg 64 has a distal end 65 that lies in a plane common with the distal ends 34-38 of the respective first 28, second 30 and third 32 legs. In other words, the distal ends 34-38 and 65 all rest upon the floor to provide stable purchase for the device 20 in all modes of operation, as depicted in FIGS. 2-3, 6-7, and 9-10. The short leg 64 has a length less than the length of the first 28, second 30 and third 32 legs such that the short leg 64 is spaced apart from the fixed seat 24. Of course, many other leg configurations and arrangements are possible, with those shown in the figures representing merely a contemplated best mode.

The support structure 26 further includes a network of reinforcing members extending among and between the legs 28-32, 64 to strengthen the legs 28-32, 64. This network may include a high stretcher 66 extending between the first 28 and third 32 legs just below the fixed seat 24. The high stretcher 66 is perhaps best visible in FIGS. 1, 2, 6 and 9, and may be formed of triangular stock for primarily aesthetic purposes. Although various attachment options exist, one contemplated option includes a threaded fastener (not shown) extending internally through the high stretcher 66 and attaching to the respective first 28 and third 32 legs such as with captured nuts (not shown). A low stretcher 68 extends between the first 28 and third 32 legs adjacent the respective distal ends 34, 38.

A stub stretcher, generally indicated at 70, extends between the second leg 30 and the short leg 64. The stub stretcher 70 is shown in a stylized form in the figures including upper 72 and lower 74 bifurcated sections having gracefully curved edges. The upper bifurcated section 72 is joined to the second leg 30 by a short U-shaped cuff 76. The short cuff 76 may be glued and/or mechanically affixed to the second leg 30. The opposite end of the upper bifurcated section 72 is joined to the short leg 64 by a long U-shaped cuff 78. The long cuff 78 substantially surrounds the short leg 64 and may have a bottom end generally aligned with the distal end 65 or slightly above the distal end 65 giving the general appearance of alignment. The lower bifurcated section 74 of the stub stretcher 70 is joined to the second leg 30 by another short U-shaped cuff 80. The opposite end of the lower bifurcated section 74 is joined to the common long cuff 78 directly below the upper bifurcated section 72, and thus to the short leg 64. In this embodiment, the low stretcher 68 intersects the lower bifurcated section 74, thereby interlocking the members and enhancing the reinforcing characteristics of the support structure 26.

A pair of high footrests 82 may be provided for user convenience and comfort, as well as to contribute further to the structural integrity of the support structure 26. One of the high footrests 82 extends between the first 28 and second 30 legs, and the other high footrest 82 extends between the second 30 and third 32 legs. As shown in various figures, the respective connections of the high footrests 82 to the second leg 30 may be via the one short cuff 76. Similarly, a pair of low footrests 84 may be provided. One of the low footrests 84 extends between the first 28 and short 64 legs and the other low footrest 84 extends between the third 32 and short 64 legs. The respective connections of the low footrests 84 to the short leg 64 are via the common long cuff 78 in this embodiment. The footrests 82, 84 may be attached by any suitable technique including via mortise and tennon joints (not visible in the Figures).

The support structure 26 may still further include a seat brace 86 extending radially inwardly from the second leg 30 toward the indentation 62 of the fixed seat 24. The seat brace 84 in this embodiment is disposed in a wedge-like manner between, and in direct contact with, the fixed seat 24 and the high stretcher 66 to provide support for the portion of the fixed seat 24 otherwise cantilevered beyond the tops of the legs 28-32. The seat brace 86 may be stylized with a curved bottom edge to echo the shape of the stub stretcher 70, as shown in the figures.

The moveable arm 40 is pivotally affixed at its lower end 44 to the short leg 66 via the integrated long cuff 78. In other words, the moveable arm 40 is directly pivotally connected to the long cuff 78, and thereby indirectly pivotally affixed to the short leg 66. As perhaps best shown in FIGS. 1, 3 and 8, a small hinge hole 88 is formed through the overlapping sections of the moveable arm 40 and long cuff 78, in which a pin 90 is placed to establish a hinged joint therebetween. The lower end 44 of the movable arm 40 and the top of the short leg 64 may have complimentary curved edges like that shown in FIG. 12. Through the pivotal connection 88, 90, the moveable arm 40 is able to rotate about a portion of a revolution toward and away from the fixed seat 24 and the second leg 30. The short leg 64 remains fixed within the long cuff 78. Other mechanical variations are possible in which the moveable arm 40 is connected to the support structure 26 to enable deployment of the document shelf 22. For example, the lower end 44 could be attached by a sliding connection, a four-bar linkage, or the like. The moveable arm 40 might also be designed with some type of outrigger or buttress feature that engages the floor when deployed for added stability and/or tipping prevention.

A stop cord 92 may be provided to limit rotation of the moveable arm 40 away from the second leg 30. The stop cord 92 is shown wrapping behind the long cuff 78 and through the upper bifurcated section 72 of the stub stretcher 70. A retainer 93 may be applied to the movable arm 70 to hold the stop cord 92 in position. A suitable rotation limit may be established after approximately 30 degrees of rotation; however this angle is variable within a reasonable range. In a contemplated embodiment, the retainer 93 may be selectively moved up or down the face of the movable arm 40 to effect minor angle changes. The stop cord 92 may be replaced by any suitable device or engineered feature to limit rotation of the moveable arm 40, and indeed may be adjustable so that multiple pre-set stop angles are available to suit a user's choice. For one example, a specially designed hinge like that found in some adjustable backrests for chaise lounge type outdoor furniture may be used.

The moveable arm 40 is preferably extendable, as shown by comparison of FIGS. 7 and 10. More specifically, the upper end 42 of the moveable arm 40 may be telescopically extendable relative to the lower end 44. In this configuration, the moveable arm 40 is composed of upper 94 and lower 96 sections. The lower end 44 comprises the lowermost part of the lower section 94, whereas the upper end 42 comprises the uppermost part of the upper section 92. The recessable joint 46 is affixed directly to the upper section 94 of the moveable arm 40, and even more specifically to its upper end 42. As shown, the lower section 96 may be generally hollow into which the upper section 94 slides, although other arrangements are possible. The telescopic feature of the moveable arm 40 could of course be implemented in various alternative ways. Likewise, the design of the moveable arm 40 could be altered to provide even greater extension range, such as by using three or more telescopic sections, or by other mechanical measures.

A latch 98 may be operatively disposed between the upper 94 and lower 96 sections for selectively locking the upper end 42 in at least one extended position. The latch 98 may take any suitable form, including for example a spring-biased ratchet like that suggested in the figures, or a fiction catch, wedge lock, roller lock, pin-and-hole arrangement, etc. The illustrated embodiment includes a series of three evenly spaced notches 100, 102 and 104 into which the latch 98 may seat and grip to hold the upper section 94 in any of three successively extended conditions, perhaps best shown in FIG. 12. In FIGS. 8-10, the latch 98 is shown seated in the second notch 102 thus providing a medium height vertical rise to the document shelf 22. In FIGS. 4-7, the latch 98 is shown seated in the third notch 104 to obtain the highest possible vertical rise to the document shelf 22 in this particular embodiment. Of course, more or fewer notches could be provided to alter the number of possible extension options. Depending on the specific design of the moveable arm 40, more than one latch—and indeed more than one type of latch—may be needed.

Perhaps best shown in FIG. 11, the document shelf 22 may include a table bracket 106. The table bracket 106 is selectively operable to engage the moveable arm 40 in the optional configured side table mode of operation, illustrated in FIGS. 8-10. The table bracket 106 may take any suitable form, and in this embodiment comprises a formed metallic wire. The table bracket 106 is preferably designed to stow unobtrusively when not in use. This may be accomplished in a variety of ways including, for example, by forming a groove 108 in the back plate 56 of the document shelf 22. Keepers 110 may be glued into the groove 108 at each end of the table bracket 106 to establish a pivot axis from which the table bracket 106 can swing into and out of the groove 108. When the table bracket 106 is deployed, it may be rotated in conjunction with placement of the document shelf 22 in the side table mode. The swinging tip of table bracket 106 may be placed in notch 112 in the upper section 94 of the moveable arm 40 to create a triangular truss-like support system. The notch 112 is best shown in FIG. 11.

A locking member may be operatively disposed between the fixed seat 24 and the document shelf 22 for holding the fixed seat 24 and the document shelf 22 securely together as a unit when the device 20 is disposed in the stowed condition. The locking member may take any suitable form or implementation, including latches, buckles, pins, etc. Alternatively, nesting or interlocking ridges or other mating features of the fixed seat 24 and back plate 56/ledge 58 could serve as a type of locking member. In the illustrated embodiment, the locking member comprises three strong magnets. Two of the magnets 114 are affixed to the ledge 58 of the document shelf, and one magnet 116 to the back plate 56. Opposing magnetic features 118, 120, respectively, are affixed to the fixed seat 24. The opposing magnetic features 118, 120 may be oppositely-poled magnets or simple ferrous buttons. Reversing the respective locations of the magnets and opposing elements is of course possible. These magnetic locking members 114-120 magnetically interact to hold the fixed seat 24 and the document shelf 22 securely together as a unit when the device 20 is in the stowed condition. Preferably, the one magnet 116 in the back plate 56 is disposed proximate the table bracket 106 so that when the bracket 106 is retracted into the groove 108, the magnetic field of the magnet 116 will help to restrain the table bracket 106 in the groove 108.

In the preferred embodiment described above and shown in the Figures, the subject seating device 20 takes the form of a free-standing stool that can be reconfigured in use to deploy a concealed music stand/lectern or alternatively a small side table depending how it is unfolded. The need for this invention is made evident by the many instances when a seated person could benefit from a nearby shelf to hold documents and other light-weight articles. Stand-alone music stands and lecterns used for these purposes are cumbersome. Prior art examples of a seating device with integrated document supporting shelf are incapable of collapsing to a stowed condition with the seat remaining functional. By contrast, the subject seating device 20, with its integrated stand/side table, provides a useful and novel solution. The subject seating device 20 can be easily reconfigured to reveal a shelf 22 for papers, e-Readers and electronic tablets without compromising its ability to support a human body in the usual seated manner. The height of the deployable shelf 22 can be adjusted via a telescopic arm 40. When deployed, the shelf 22 can be alternatively configured in lectern and side table modes. When not needed, the shelf 22 is stowed out of the way where it nests almost imperceptibly with the fixed seat 24. Preferably, the fixed seat 24 remains stationary as the shelf 22 is manipulated between stowed and deployed conditions. Non-stool applications of this invention will be apparent to those skilled in the art, including within the context of chairs, benches and other types of seating devices.

The foregoing invention has been described in accordance with the relevant legal standards, thus the description is exemplary rather than limiting in nature. Variations and modifications to the disclosed embodiment may become apparent to those skilled in the art and fall within the scope of the invention. Reference numbers are provided in the claims for convenience, and are not to be construed as limiting in any way.

What is claimed is:

1. A seating device (20) that may be reconfigured in use without destroying the utility of said device (20) as a body support, said device (20) comprising:

a seat surface (24) for supporting a human body in a sitting posture;

a support structure (26) for supporting said seat surface (24) at an elevated position above a floor surface;

a moveable arm (40) having upper (42) and lower (44) ends, said lower end (44) moveably connected to said support structure (26) and said upper end (42) extending laterally outwardly and upwardly therefrom in a deployed condition;

a document shelf (22) connected to said upper end (42) of said moveable arm (40) in said deployed condition to support documents at a convenient reading distance laterally elevated relative to said seat surface (24) while said seat surface (24) supports a human body;

a recessable joint (46) connecting said document shelf (22) and said moveable arm (40), said recessable joint (46) moveable to a tucked position below said seat surface (24) in conjunction with reconfiguration of said document shelf (22) to a stowed condition adjacent said seat surface (24), wherein the functionality of said seat surface (24) as a body support is substantially unimpeded when said document shelf (22) is in either of said stowed and deployed conditions; and a fixed seat (24) defining said seat surface (24) for supporting a human body in a sitting posture; said document shelf (22) nestling with said fixed seat (24) when said device (20) is disposed in said stowed condition; wherein said document shelf (22) overlies said fixed seat (24) when said device (20) is disposed in said stowed condition.

2. The seating device (20) of claim 1, wherein said recessable joint (46) is affixed directly to said upper end (42) of said moveable arm (40).

3. The seating, device (20) of claim 2, wherein said document shelf (22) is hingedly connected to said recessable joint (46).

4. The seating device (20) of claim 3, wherein said recessable joint (46) includes a section (48) offset laterally relative to said moveable arm (40).

5. The seating device (20) of claim 1, wherein said document shelf (22) is generally inaccessible when disposed in said stowed condition and exposed when disposed in said deployed condition; said fixed seat (24) having an indentation (62) to provide clearance for said document shelf (22) when disposed in said stowed condition.

6. The seating device (20) of claim 1, wherein said upper end (42) of said moveable arm (40) includes an upper section (94) associated with said upper end (42) and a lower section (96) associated with said lower end (44), said upper section (94) being telescopically extendable relative to said lower section (96).

7. The seating device (20) of claim 6 further including a fixed seat (24); wherein said support structure (26) comprises at least a first leg (28) having a full length and extending downwardly from said fixed seat (24) to a distal end (34), and a short leg (64) having a length less than said full length of said first leg (28) and a distal end (65) generally co-planar with said distal end (34) of said first leg (28) and wherein said moveable aim (40) is pivotally affixed at said lower end (44) thereof to said short leg 64).

8. The seating device (20) of claim 7, a restraint member for limiting rotation of said moveable arm (40) away from said short leg (64) and arresting said moveable arm (40) in said deployed condition.

9. The seating device (20) of claim 8, wherein said restraint member includes a stop cord (92).

10. The seating device (20) of claim 6, wherein said moveable arm (40) includes a latch (98) operatively disposed between said upper (94) and lower (96) sections for selectively locking said upper section (94) in at least one extended position.

11. The seating device (20) of claim 1, wherein said document shelf (22) further includes a table bracket (106) selectively operable to engage said moveable arm (40).

12. The seating device (20) of claim 11, wherein said table bracket (106) comprises a formed metallic wire.

13. The seating device (20) of claim 1, further including a fixed seat (24); a locking member operatively disposed between said fixed seat (24) and said document shelf (22) for holding said fixed seat (24) and said document shelf (22) securely together as a unit when said device (20) is disposed in said stowed condition.

14. The seating device (20) of claim 13, wherein said locking member includes at least one magnet (114, 116, 118, 120) affixed to one of said fixed seat (24) and said document shelf (22).

15. The seating device (20) of claim 14, wherein said document shelf (22) further includes a table bracket (106) selectively operable to engage said moveable arm (40), and wherein said at least one magnet (116) is disposed proximate said table bracket (106).

16. The seating device (20) of claim 1, further including a fixed seat (24) defining a center line (A); said support structure (26) comprising first (28), second (30) and third (32) legs extending downwardly from said fixed seat (24) to respective distal ends (34, 36, 38) for supporting said fixed seat (24) at an elevated position above the floor surface; said first (28), second (30) and third (32) legs having a generally equivalent full length; said first (28), second (30) and third (32) legs generally equally radially spaced from said center line (A): said first (28) and third (32) legs generally diametrically opposed relative to center line (A); said second leg (30) spaced generally circumferentially equally between said first (28) and third (32) legs relative to center line (A); a short leg (64) disposed generally diametrically opposite to said second leg (30) relative to said center line (A); said short leg (64) having a distal end (65) disposed in a plane common with said distal ends (34, 36, 38) of said respective first (28), second (30) and third (32) legs; said short leg (64) having a length less that said full length of said first (28), second (30) and third (32) legs such that said short leg (64) is spaced apart from said fixed seat (24).

17. The seating device (20) of claim 16, further including a stub stretcher (70) extending between said short leg (64) and at least one of said first (28), second (30) and third (32) legs.

18. A stool (20) for sitting that may be partially reconfigured in use to present a previously inaccessible non-occupant supporting surface, said stool (20) comprising:

a fixed seat (24) defining a generally horizontal seat surface for supporting a human body in a sitting posture;

a support structure (26) extending downwardly from said fixed seat (24), said support structure (26) comprising at least one leg (28, 30, 32);

said fixed seat (24) rigidly attached relative to said at least one leg (28, 30, 32);

a moveable arm (40) having upper (42) and lower (44) ends, said lower end (44) moveably connected to said support structure (26) and said upper end (42) extending laterally outwardly and upwardly therefrom in a deployed condition; said upper end (42) of said moveable arm (40) being telescopically extendable relative to said lower end (44); a latch (98) for selectively locking said upper end (42) in at least one extended position;

a document shelf (22) connected to said upper end (42) of said moveable arm (40); said document shelf (22) effective in said deployed condition to support documents at a convenient reading distance laterally elevated relative to said fixed seat (24) while said fixed seat (24) supports a human body;

a recessable joint (46) connecting said document shelf (22) and said moveable arm (40), said recessable joint (46) moveable to a tucked position directly below said seat surface (24) in conjunction with reconfiguration of said document shelf (22) to a stowed condition;

said document shelf (22) overlying said fixed seat (24) when said stool (20) is disposed in said stowed condition; and said fixed seat (24) being arranged so as to remain stationary while said document shelf (22) is moved between said stowed and deployed conditions.

* * * * *